US007137226B2

(12) United States Patent
Fiutak et al.

(10) Patent No.: US 7,137,226 B2
(45) Date of Patent: Nov. 21, 2006

(54) LAMINATED SUPPORT MAT

(75) Inventors: Jon C. Fiutak, Cape Elizabeth, ME (US); Shane M. McDougall, Caribou, ME (US); Albert P. Putnam, III, Winterport, ME (US)

(73) Assignee: John E. Anthony, Sheridan, AR (US)

( * ) Notice: Subject to any disclaimer, the term of this patent is extended or adjusted under 35 U.S.C. 154(b) by 128 days.

(21) Appl. No.: 11/011,724

(22) Filed: Dec. 14, 2004

(65) Prior Publication Data

US 2006/0070346 A1 Apr. 6, 2006

Related U.S. Application Data

(63) Continuation-in-part of application No. 10/377,009, filed on Feb. 28, 2003.

(60) Provisional application No. 60/394,814, filed on Jul. 10, 2002.

(51) Int. Cl.
*E04C 5/08* (2006.01)

(52) U.S. Cl. ..... 52/223.7; 52/177

(58) Field of Classification Search ..... 404/36, 404/46, 17, 34, 35; 52/177, 223.9, 223.6, 52/223.7; 428/54, 57
See application file for complete search history.

(56) References Cited

U.S. PATENT DOCUMENTS

| | | | | |
|---|---|---|---|---|
| 3,325,037 | A | 6/1967 | Kohn et al. | |
| 3,447,996 | A | 6/1969 | Himmelheber et al. | |
| 3,905,172 | A | 9/1975 | Blackburn | |
| 4,078,348 | A | 3/1978 | Rothman | |
| 4,271,649 | A | 6/1981 | Belanger | |
| 4,312,908 | A | 1/1982 | Jasperson | |
| 4,533,589 | A | 8/1985 | Sewell | |
| 4,784,887 | A | 11/1988 | Abendroth | |
| 4,801,483 | A | 1/1989 | Beckerman et al. | |
| 4,932,178 | A * | 6/1990 | Mozingo | 52/223.7 |
| 4,965,973 | A | 10/1990 | Engebretsen | |
| 5,002,105 | A | 3/1991 | Bodig | |
| 5,087,149 | A * | 2/1992 | Waller, Jr. | 404/35 |
| 5,097,558 | A * | 3/1992 | Accorsi et al. | 14/73 |
| 5,282,692 | A * | 2/1994 | McLeod | 404/35 |
| 5,305,568 | A | 4/1994 | Beckerman | |
| 5,313,758 | A | 5/1994 | Willman et al. | |
| 5,362,545 | A | 11/1994 | Tingley | |
| 5,565,257 | A | 10/1996 | Tingley | |
| 5,603,134 | A * | 2/1997 | Whipkey et al. | 14/2.4 |
| 5,736,218 | A | 4/1998 | Iwata et al. | |
| 5,756,975 | A | 5/1998 | Harris et al. | |
| 6,050,047 | A | 4/2000 | Covelli et al. | |
| 6,214,428 | B1 * | 4/2001 | Henderson | 428/54 |
| 6,224,704 | B1 | 5/2001 | Bassett et al. | |

(Continued)

FOREIGN PATENT DOCUMENTS

CH 663 980 A5 1/1988

(Continued)

OTHER PUBLICATIONS

"Acceptance Criteria for Structural Composite Lumber", ICBO Evaluation Service, Inc., Copyright 2002.

(Continued)

*Primary Examiner*—Naoko Slack
*Assistant Examiner*—Jessica Laux
(74) *Attorney, Agent, or Firm*—MacMillan, Sobanski & Todd, LLC

(57) ABSTRACT

A support mat, such as a mat suitable for supporting heavy construction equipment, includes a plurality of beams fastened together, each of the beams being made of a plurality of individual wood laminations.

8 Claims, 2 Drawing Sheets

U.S. PATENT DOCUMENTS

| | | | | |
|---|---|---|---|---|
| 6,281,148 | B1 | 8/2001 | Dagher et al. | |
| 2002/0188074 | A1 | 12/2002 | Parker et al. | |
| 2003/0113162 | A1 | 6/2003 | Seaux et al. | |
| 2003/0133751 | A1* | 7/2003 | Smith | 404/35 |
| 2004/0042851 | A1* | 3/2004 | Davis et al. | 404/35 |

FOREIGN PATENT DOCUMENTS

| | | |
|---|---|---|
| JP | 10-115026 | 5/1998 |
| JP | 10-237982 | 9/1998 |
| WO | PCT/US03/21541 | 10/2003 |

OTHER PUBLICATIONS

"Adhesive Bonding of Wood Materials", Charles B. Vick p. 9-1-9-24.

"Building Materials" by Engineered Wood Products by Williamette retrieved from www.wii.com on Dec. 21, 2001.

Georgia-Pacific Engineered Lumber Products, G-P Lam Beams and Headers retrieved from www.gp.com on Dec. 21, 2001.

Georgia-Pacific, Brochure/Flyer on Laminated Veneer Lumber (LVL).

"Laminating Effects in Glued-Laminted Timber Beams" by Robert H. Falk et al. From Journal of Structural Engineering, Dec. 1995, pp. 1857-1863.

Laminated Veneer Lumber, LVL, Overview of the Product, Manufacturing and Market Situation by Department of Forest Products Marketing, http://www.hochstrate.de/micha/reports/replvl.html dated Jan. 30, 2003.

Laminated Veneer Lumber (LVL), StrucLam by Williamette, http://www.wii.com/LVLl.html dated Dec. 21, 2001.

Numerical Investigations of the Laminating Effect In Laminated Beams: by Erik Serrano et al., Journal of Structural Engineering dated Jul. 1999, pp. 740-745.

Boise Cascade Engineered Wood Products Division, Versa-Lam Products, www.bcewp.com, Dec. 21, 2001.

* cited by examiner

LAMINATED SUPPORT MAT

RELATED APPLICATIONS

This application is a Continuation-In-Part application of U.S. patent application Ser. No. 10/377,009, filed Feb. 28, 2003, and entitled METHOD OF MAKING LAMINATED WOOD BEAMS WITH VARYING LAMINATION THICKNESS THROUGHOUT THE THICKNESS OF THE BEAM, all of which is incorporated in the present application in its entirety. Application Ser. No. 10/377,009 claims priority from U.S. Provisional Patent Application Ser. No. 60/394,814, filed Jul. 10, 2002, and is entitled LAMINATED WOOD BEAMS WITH VARYING LAMINATION THICKNESS THROUGHOUT THE THICKNESS OF THE BEAM.

BACKGROUND OF THE INVENTION

This invention relates in general to support mats for supporting heavy equipment, and in particular, to an improved support mat and a method of making such support mats.

The construction industry utilizes solid sawn wood and wood panel members in a variety of forms to aid in the erection of buildings, roads, and bridges. For example, temporary road panels and crane mats are often constructed using solid-sawn hardwood timbers or some species of softwoods. These panels are used to form a temporary lightweight roadway or foundation to facilitate vehicular and equipment travel as may be required in construction operations. Other industry users of such mats include users in the field of pipeline, utility, transportation, oil, and infrastructure.

As shown in FIG. 1, a conventional road panel, shown generally at 10, is formed by using a plurality of solid sawn timber elements 12. Typically, four pieces of solid sawn timber 12 are used, each having a cross-sectional dimension ranging from about 8 inches×8 inches to about 12 inches×12 inches, with a length of 16 feet. The four pieces of timber 12 are usually bolted together using bolts 14 to form the temporary road panel 10 having an assembled dimension of 4 feet×1 foot×16 feet. Several panels can be placed side by side over existing ground to form a temporary roadway or to support cranes on a construction site. Ground conditions under the panels vary greatly and may include, for example, sand, clay, wetlands, and possibly a considerable amount of water. Another conventional wood mat utilizes smaller dimensional lumber and utilizes nails, carriage bolts, or steel rods as a fastening system. All of these systems have mechanical fastening systems to transfer stresses between components.

The hardwood panels are typically discarded at the end of the construction project, or they may be re-used if they are in relatively good condition. The longevity of the panels may be as little as six months to one year, depending on the length of the construction project and the environmental conditions to which the panels are subjected. The wood panels are typically untreated with preservative chemicals because of environmental concerns. Hardwoods are typically used because of their superior wear resistance to heavy truck and other construction equipment traffic. In addition to road panels and crane mats, other applications for the hardwood panels include decks over steel girders for temporary bridges, and soldier piles.

Because the timber used to form the panel 10 is expensive, the panel 10 is very costly. Further, the roadway formed by the panels 10 is very costly because tens of thousands of the panels 10 may be used for a single construction project. In addition, the solid sawn timber used to form the panel 10 is scarce because of the solid sawn timber must be extremely long, typically about sixteen feet in length. Further, each timber 12 is typically has an allowable design strength value within the range of from about 650 psi (pounds per square inch) to about 700 psi., thereby limiting the type and size of equipment which can be supported thereon. Therefore, it would be desirable to provide an improved support mat for supporting heavy equipment.

SUMMARY OF THE INVENTION

The above objects as well as other objects not specifically enumerated are achieved by a support mat comprising a plurality of beams fastened together, each of the beams being made of a plurality of individual wood laminations.

According to this invention there is also provided a support mat comprising a plurality of beams fastened together, each of the beams being made of a plurality of individual wood laminations, wherein individual wood laminations are adhesively bonded to each other, and the beams have a strength value greater than about 3000 psi.

According to this invention there is also provided a support mat comprising a plurality of beams fastened together, each of the beams being made of a plurality of individual wood laminations adhesively bonded to each other, and wherein each of the laminated beams comprises a plurality of vertically oriented individual wood laminations, the plurality of individual wood laminations having the wide face being oriented parallel to a direction of a load applied to the support mat.

Various objects and advantages of this invention will become apparent to those skilled in the art from the following detailed description of the preferred embodiment, when read in light of the accompanying drawings.

DETAILED DESCRIPTION OF THE INVENTION

Figure 2:
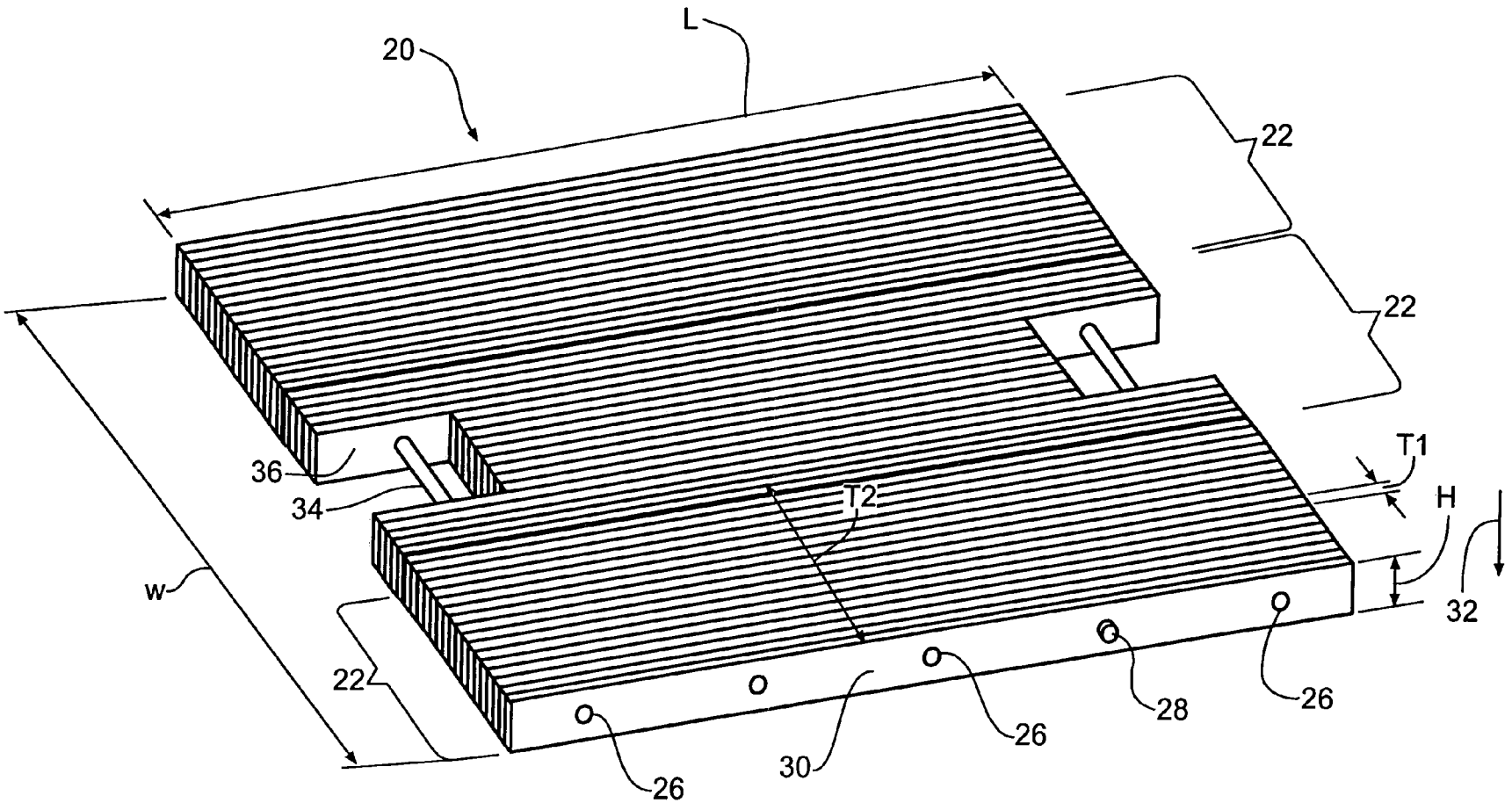
FIG. 2 is a side perspective view of a laminated support mat according to the invention.

As shown in FIG. 2, a laminated support mat, indicated generally at 20, is comprised of a plurality of laminated beams 22. Each beam 22 comprises a plurality of wooden members or individual wood laminations 24. As used in the description of the invention, the term "mat" includes mats as well as panels. Optional apertures 26 can be formed through the support mat 20 for receiving fastening means 28, as will be described herein.

The individual wood laminations 24 are preferably fabricated by structurally joining together arbitrary or different lengths or strips of wood material. Preferably, the arbitrary strips of wood material are disposed end-to-end and joined together, preferably by a jointing process, such as, for example, by finger jointing. It is to be understood that the strips can be continuous and full length. More preferably, the arbitrary strips of wood are strips of hardwood, such as oak, birch, or maple, although any desired hardwood can be used. Softwoods can also be used, but are not usually preferred. The strips of wood laminations 24 can be any length, such as a length within the range of from about 5 feet to about 16 feet. The strips of wood material can be joined together to define the individual wood laminations 24 of any desired length, such as individual wood laminations having a length of about 16 feet. It will be understood however, that the individual wood laminations 24 can be of any other desired length. Not all the wood laminations 24 need to be formed by joining together the strips, and the beam can be formed with some of the laminations formed by joined strips, and some of the wood laminations 24 being a continuous piece of full length. Preferably, at least 50 percent of the wood laminations are made of strips joined together.

The individual wood laminations 24 preferably have a height H within the range of from about 3 inches to about 6 inches. More preferably, the individual wood laminations 24 have a height H of about 5½ inches. The individual wood laminations 24 can have any desired thickness T1. Preferably, the individual wood laminations 24 have a thickness T1 within the range of from about 0.50 inches to about 1.00 inches. A typical laminated beam 22 might contain 14 to 16 laminations and have a width T2 of about 12 inches.

A plurality of the individual wood laminations 24 are joined together to form the laminated beams 22. Preferably, the individual wood laminations 24 are vertically oriented, having a wide face 30 oriented parallel to a direction of a load applied to the laminated beam 22, with the load being indicated by arrow 32.

The individual wood laminations 24 can be joined together into the beam 22 using any desired adhesive. Preferably, the individual wood laminations 24 are joined together with a waterproof adhesive, such. as an adhesive that conforms to ASTMD2559-01. Preferably, the number of individual wood laminations 24 joined together to form the laminated beam 22 is a number within the range of from about 20 to about 30 laminations, although any number of individual wood laminations 24 can be used. More preferably, about 26 laminations are assembled together to form the laminated beam 22. Each beam 22 includes outboard laminations, as shown in FIG. 2. The wide faces of the outboard laminations of each beam, such as the wide face 30, define a wide face of the beam 22.

The laminated beam 22 can have any desired width T2. Preferably, the laminated beam 22 has a width T2 of about 12 inches. The laminated beams 22 can have any desired length L, such as, for example, a length L of about 12 feet. It will be understood however, that the laminated beams 22 can have any other desired length. As described regarding the individual wood laminations 24, the laminated beams 22 preferably have a height H within the range of from about 3 inches to about 6 inches. More preferably, the laminated beams 22 have a height H of about 5½ inches.

A plurality of laminated beams 22 can be attached to one another by any suitable means to form the laminated support mat 20. In the illustrated embodiment, the wide faces 30 of the outboard laminations of adjacent beams 22 touch each other. Preferably, the beams 22 are assembled together with a fastener, such as bolts 28 that extend through bolt apertures 26. It will be understood that any other desired fastener can be used. Adhesive, binding wire, shear connections or brackets, all not shown, can also be used to connect the laminated beams 22 together into the mat 20. These mechanical fastening systems allow stresses to be transferred between components. An adhesive can be used in conjunction with a mechanical fastening system. As shown in FIG. 2, three laminated beams 22 are attached to one another to form the support mat 20. The three laminated beams 22 further define a width W for the entire support mat 20. It will be understood however, that any desired number of laminated beams 22 can be attached to one another to form the support mat 20. Also, the laminated beams need not all be of the same width T2, but can be of different thicknesses.

If desired, the beams 22 can be provided with one or more lifting members 34 for the attachment of lifting cables, not shown. Optionally, the lifting members 34 are positioned within recesses 36. The recesses are preferably formed at any location along an edge of the support mat 20. Preferably, the recess 34 are formed at any location along the width W of the support mat 20.

One advantage of the present invention is that the laminated beams 22 have an allowable design strength value greater than about 3000 psi. Bending strength is measured, destructively, utilizing a 4-point bending test apparatus such as described in ASTM D198-00, with the wide face of the laminations parallel to the direction of applied load. Such a strength is superior to known sawn timber beams which typically have a strength value within the range of from about 650 psi to about 700 psi.

Figure 1:
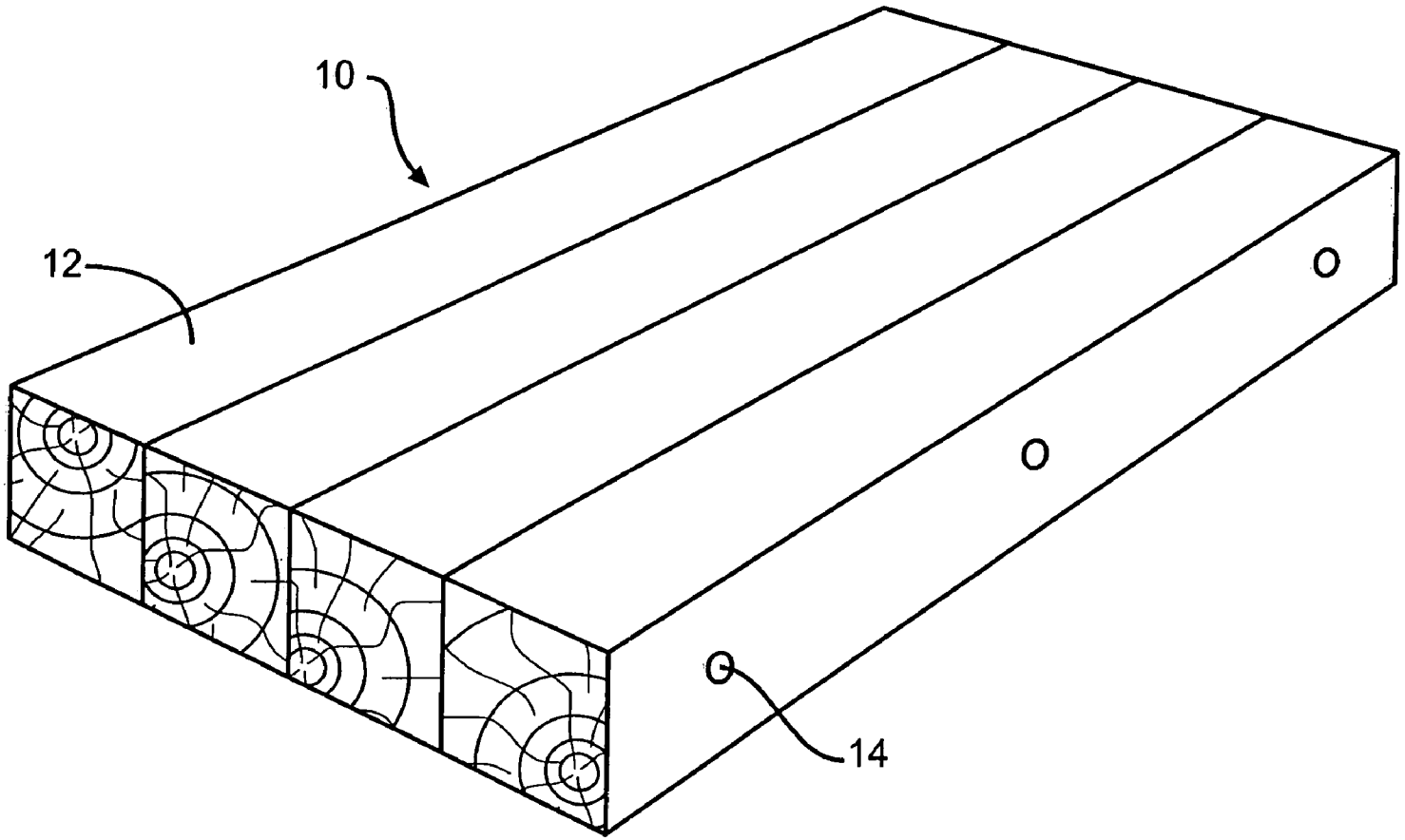
FIG. 1 (PRIOR ART)
FIG. 1 is a side perspective view of a conventional road panel formed of solid sawn timber.

Another advantage of the present invention is that the support mat 20 has a smaller height H relative to known wood mats, such as the prior art mat 10 in FIG. 1. The support mat 20 is thereby easier to move and to store, and requires a smaller amount of wood material, thereby efficiently using raw material resources and making the mat less costly.

Yet another advantage of the invention is that the mats 20 can be made with a tailor-made strength profile for particular strength applications. Further, raw material defects, such as knots, will be well distributed throughout the structure because each knot will have a thickness that is no thicker than the width T1 of the laminations. This is relatively small in comparison with the thickness or width T2 of the laminated beam 22.

Another advantage of the present invention is that the support mat 20 has a weight that is within the range of from about 25 percent to about 60 percent lighter than prior art mats having the same surface area, such as, for example, the mat 10. Preferably, the support mat 20 is about 50 percent of the weight of a prior art mat having the same surface area, such as, for example, the mat 10.

Although the beams 22 are shown as having individual wood laminations 24 of a generally uniform thickness T1, it is to be understood that the beams 22 can be made of individual wood laminations 24 that vary in thickness across the width T2 of the beam. Also, the beams 22 on the outer edges of the width W of the mat 20 need not be identical to the beam 22 in the central portion of the mat 20.

In another variation of the invention some or all of the individual wood laminations 24 are reinforced with a reinforcement material to make them capable of withstanding greater loads. The reinforcement material can be any material suitable for improving the strength of the overall beam 22 and the mat 20. For example, a layer of woven or nonwoven fiberglass strands can be applied between adjacent laminations 24.

The principle and mode of operation of this invention have been described in its preferred embodiments. However, it should be noted that this invention may be practiced otherwise than as specifically illustrated and described without departing from its scope.

What is claimed is:

1. A support mat comprising a plurality of beams fastened together, each of the beams being made of a plurality of individual wood laminations adhesively bonded to each other, wherein each of the laminated beams comprises a plurality of vertically oriented individual wood laminations, the plurality of individual wood laminations having wide faces oriented parallel to a direction of a load applied to the support mat, each beam having outboard laminations, the wide faces of the outboard laminations of each beam defining a wide face of the beam, and wherein the wide faces of adjacent beams touch each other.

2. The support mat according to claim 1, wherein the wide faces of adjacent beams are adhesively bonded to each other.

3. The support mat according to claim 1, wherein the beams have a strength value greater than about 3000 psi.

4. The support mat according to claim 1, wherein each of the beams has height within the range of from about 3 inches to about 6 inches.

5. The support mat according to claim 1, wherein the support mat further includes fasteners for bonding adjacent beams to one another.

6. The support mat according to claim 5, wherein the fasteners include bolts extending through the beams.

7. The support mat according to claim 1, wherein the individual wood laminations are formed from hardwood.

8. The support mat according to claim 1, wherein at least 50 percent of the laminations are made of strips joined together to form the laminations.

* * * * *